US005111934A

United States Patent [19]

Morin

[11] Patent Number: 5,111,934

[45] Date of Patent: May 12, 1992

[54] PORTABLE CLEANING KIT

[76] Inventor: Eugéne Morin, 842, Ruisseau de Anges Sud, Apt. 3, Saint-Roche-de-l'Achigan, Québec, Canada, J0K 3H0

[21] Appl. No.: 733,878

[22] Filed: Jul. 22, 1991

[51] Int. Cl.[5] ..... B65D 71/02

[52] U.S. Cl. ..... 206/229; 206/361; 206/812; 15/104.94

[58] Field of Search ..... 206/812, 229, 494, 361; 15/104.93, 104.94; 383/35; 229/123.1

[56] References Cited

U.S. PATENT DOCUMENTS

| | | | |
|---|---|---|---|
| 2,197,113 | 4/1938 | Piazze | 383/35 |
| 2,968,396 | 1/1961 | Pratt | 206/631 |
| 3,217,353 | 11/1965 | Karcher, Jr. | 15/104.94 |
| 3,561,456 | 2/1971 | Stuart | 206/229 |
| 3,608,708 | 9/1971 | Storandt | 206/361 |
| 3,826,259 | 7/1974 | Bailey | 206/229 |
| 4,457,640 | 7/1984 | Anderson | 15/104.94 |
| 4,601,081 | 7/1986 | Sutton et al. | 15/104.94 |
| 4,610,357 | 9/1986 | Nakamura | 206/494 |
| 4,656,068 | 4/1987 | Raines | 229/123.1 |
| 4,796,751 | 1/1989 | Madkow | 206/812 |
| 4,959,881 | 10/1990 | Murray | 15/104.94 |

FOREIGN PATENT DOCUMENTS

| | | | |
|---|---|---|---|
| 2142895 | 1/1985 | United Kingdom | 206/812 |

*Primary Examiner*—Stephen P. Garbe
*Assistant Examiner*—Christopher McDonald
*Attorney, Agent, or Firm*—Pierre Lespérance

[57] ABSTRACT

A portable cleansing kit comprising a flat, flexible packet having two separate, stacked, air-tight, openable, flat compartments each comprising tow quadrangular walls sealed together around the entire periphery of the walls. The four walls define a pair of outer walls and a pair of inner walls, the latter walls adjacent to each other and sealed to each other along three sides of their periphery, an opening being formed between the fourth sides of the inner walls to gain access to a gap defined between the inner walls. A sponge moistened with a cleansing liquid solution is located with one compartment and adhered to the associated inner wall by glue. A sheet of dry, wiping, liquid absorbing towel material is loosely contained in the other compartment the sponge compartment outer wall has an intermediate, outwardly projecting, semi-circular ear about the opening for manual capture and pulling in view of gaining access to the sponge compartment, either by free engagement of a person's finger into said sponge compartment or by outright peeling off of the sponge compartment outer wall to completely expose said sponge.

2 Claims, 3 Drawing Sheets

PORTABLE CLEANING KIT

FIELD OF THE INVENTION

This invention generally relates to the cleanliness of public lavatories and W. C.

BACKGROUND OF THE INVENTION

Travellers are not infrequently confronted with the unpleasant perspective of having to use dirty public toilets, with a high concern being placed on the level of cleanliness of the toilet bowl seat. To the knowledge of the present inventor, there is no package available specifically produced for the traveller in order to enable one to clean himself the toilet bowl seat of a public W. C. This applies to all places susceptible to be contaminated such as restaurants, hotels, airports, hospitals, etc.

OBJECT OF THE INVENTION

The object of the invention is to address the needs of the traveller with respect to the cleaning of toilet bowl seats.

SUMMARY OF THE INVENTION

In accordance with the teachings of the invention, there is disclosed a portable cleansing kit comprising a flat, flexible packet having two separate, stacked, airtight, openable, flat compartments each comprising two quadrangular walls sealed together around the entire periphery of the walls, the four walls defining a pair of outer walls and a pair of inner walls, the latter walls adjacent to each other and sealed to each other along three sides of their periphery, an opening being formed between the fourth sides of the inner walls to gain access to a gap defined between said inner walls, a sponge moistened with a cleansing liquid solution located within one compartment and adhered to the associated inner wall by adhering means, and a sheet of dry, wiping, liquid absorbing towel material loosely contained in the other compartment; wherein said sponge compartment outer wall has an intermediate outwardly projecting, semi-circular ear about said opening for manual capture and pulling in view of gaining access to said sponge compartment, either by free engagement of a person's finger into said sponge compartment or by outright peeling off of the sponge compartment outer wall to completely reveal said sponge.

DETAILED DESCRIPTION OF THE INVENTION

Figure 1:
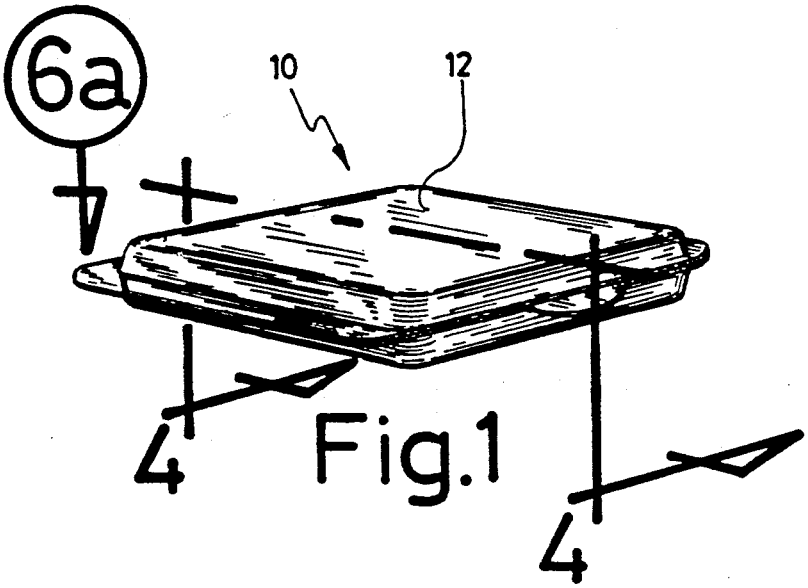
FIG. 1 is a perspective view of a sanitary towel pouch in accordance with the teachings of the invention.

The pouch 10 is substantially quadrangular and defines four main layers or sheets 12, 14, 16, 18 applied one over the other. Sheets 12–18 are made from a flexible yet resistant, impervious, plastic material, preferably reinforced by suitable means such as a flexible metallic material such as aluminum foil. A first towel sheet 22 is folded a few times onto itself and enclosed between metallic sheets 12 and 14. A sponge-type towel sheet 24 is further adhered to plastic sheet backing 16 via adhesive layer 20 and enclosed between plastic sheets 16 and 18. Thereafter, the edge sections 12*a*–18*a* of sheets 12–18 are glued, heat-sealed or otherwise sealingly secured to each other so as to define two fluid-tight chambers: chamber 26, bounded by sheet layers 12 and 14 and into which is enclosed dry towel 22, and chamber 28, bounded by sheet layers 16–18 and into which is enclosed (wetted) sponge 24.

Towels 22, 24 are preferably thicker than envelope sheets 12–18, and are made from a liquid-absorbing material. Dry-towel 22 should be made from a material such as paper, cotton or other fabric material. Towel 24 should be soaked into a solution of alcohol and salt before insertion between sheets 16 and 18. Such alcohol/salt solution may include ethyl alcohol ($CH_3CH_2OH$) and/or propyl alcohol ($CH_3CH_2CH_2OH$) and /or methanol ($CH_3OH$), together with sodium hypochlorite (NaClO) and/or potassium hypochlorite (KClO), dissolved in distilled water in ratios related to the molarity of the alcohols and to the specific uses intended for the towel. The purpose of the metallic reinforcement is to increase the resistance and fluid-tight properties of chambers 26, 28, to prevent impact bursting of the pouch, or premature evaporation of the salt/alcohol solution in chamber 28.

Figure 6:
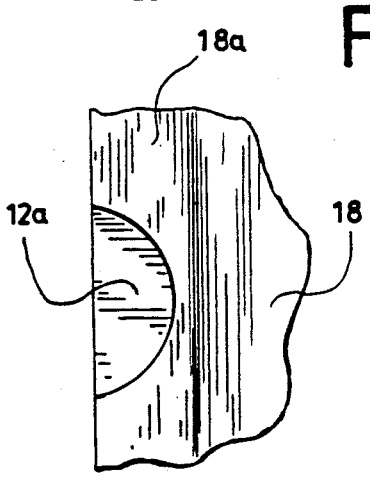
FIGS. 6,6*a* and 7 are broken plan views about two perspectives 6 (one at the intermediate edge portion and one at the corner portion thereof), and a third opposite intermediate edge portion perspective at 7.
Figure 7:
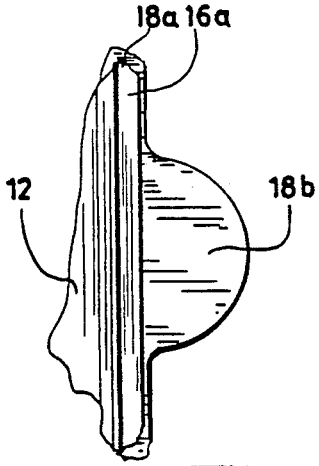
Figure 6A:
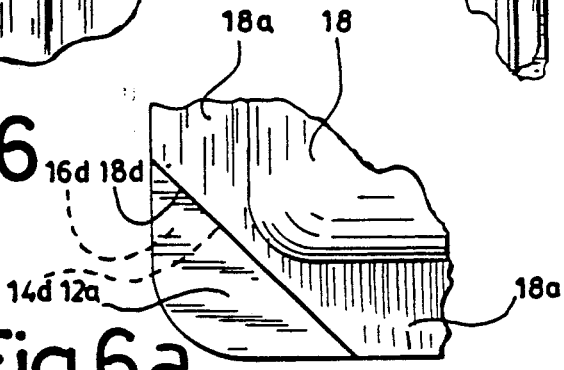

Wall 18 includes on the intermediate section of one of its four side edge portions 18*a*, a projecting semi-circular extension or ear 18*b* (FIG. 7). Moreover, on the side edge portion opposite ear 18*b*, there are provided self-registering semi-circular notches 18*c*, 16*c*, 14*c* made intermediately thereof (FIG. 6), and slanted straight notches 18*d*, 16*d*, 14*d*, made at one corner thereof (FIG. 6*a*) and merging with the adjacent orthogonal edge portion.

Figure 4:
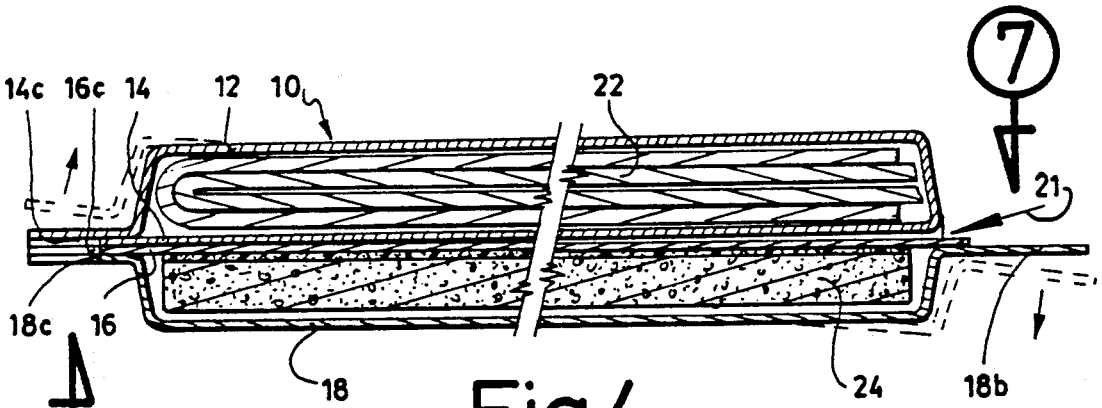
FIGS. 4–5 are enlarged, partly broken, cross-sectional views taken along line 4—4 of FIG. 1 and 5—5 of FIG. 3, respectively.
Figure 5:
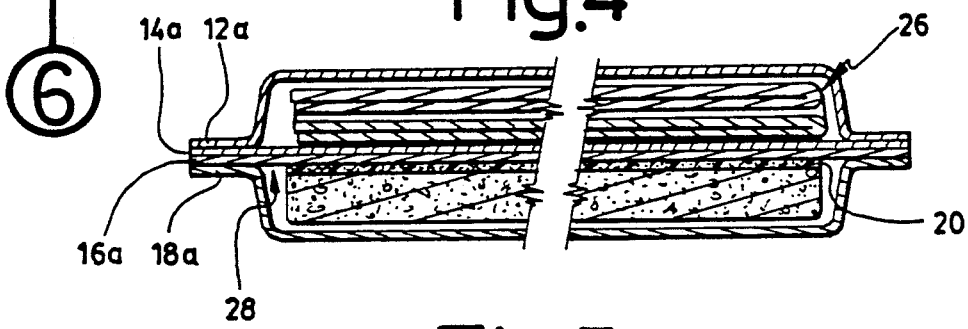

As illustrated in FIG. 4, and opening 21 is formed between the sides of the walls 14–16 in register with ear 18*b*, to gain access to dry towel 22. At this edgewise location, sheets 12 and 14 preferably edgewisely merge with one another, as suggested by FIG. 4. Thus, the glue or other adhesive binding means is not necessary between sheets 12 and 14 about opening 21.

It is understood that access to the towel 22 is possible by handgrabbing said edgewisely merging section of sheets 12 and 14, about opening 21, then lifting same away from sheet 16 to pivotally release pouch 26 from pouch 28. This pouch release occurs automatically during said pivotal motion of pouch 26, by progressive edgewise detachment of the remaining glued adjacent edge sections of sheets 14 and 16, yieldingly under the forcible bias applied by the hand of the user at opening 21. It is therefore clear why two intermediate sheets 14, 16 are provided to separate the two pouches, namely, to ensure that the sealed, airtight integrity of the pouch chambers 26, 28 is not compromised when the two pouches are detached from one another.

Figure 2:
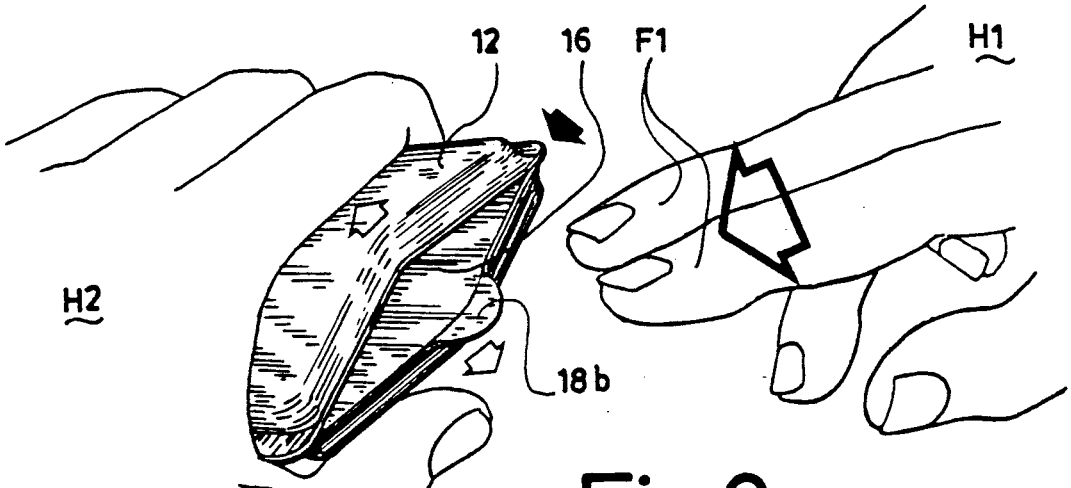
FIGS. 2 and 3 are perspective and edge views respectively of the sanitary pouch packet, sequentially showing how two fingers of a person can be cleaned with the sponge and dry towels therewithin.
Figure 3:
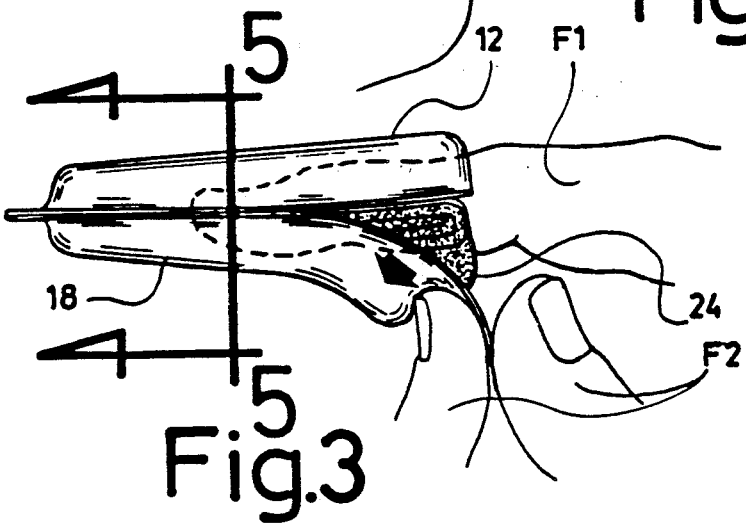

As suggested in FIGS. 2-3, one can clean his fingers F1 of a first hand H1 by pulling ear 18*b* with fingers F2 of the second hand H2, wherein chamber 28 is edgewisely opened up edgewisely of ear 18*b*, inserting the fingers F1 to be cleaned through the edgewise mouth of chamber 28 thereunto, and by rubbing these fingers F1 against the sponge 24; then retrieving the fingers F1, holding the packet 10 still with hand H2 but now edgewisely squeezing same to edgewisely open up chamber 26 again about ear 18*b*, inserting the finger F1 into chamber 26 instead of chamber 28 for drying same by rubbing. The towels 22, 24 remain in their compartments 26, 28 during this operation.

Figure 8:
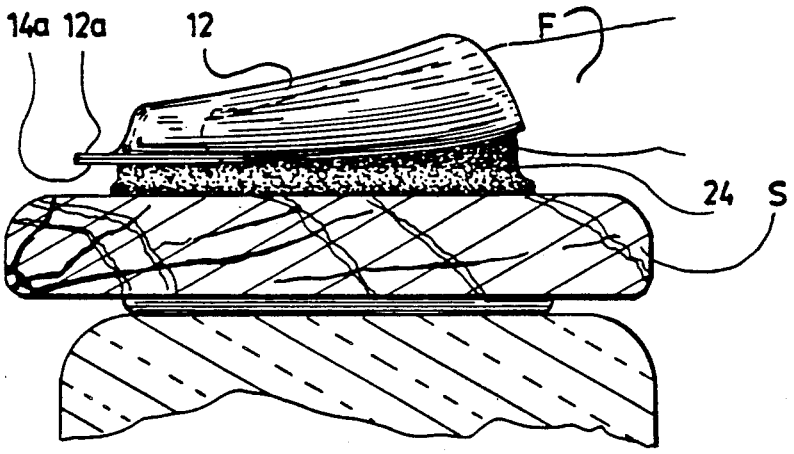
FIG. 8 is an edge view of the wet sheet envelope suggesting how it can be used and handled rubbingly against a toilet bowl seat shown fragmentarily.
Figure 9:
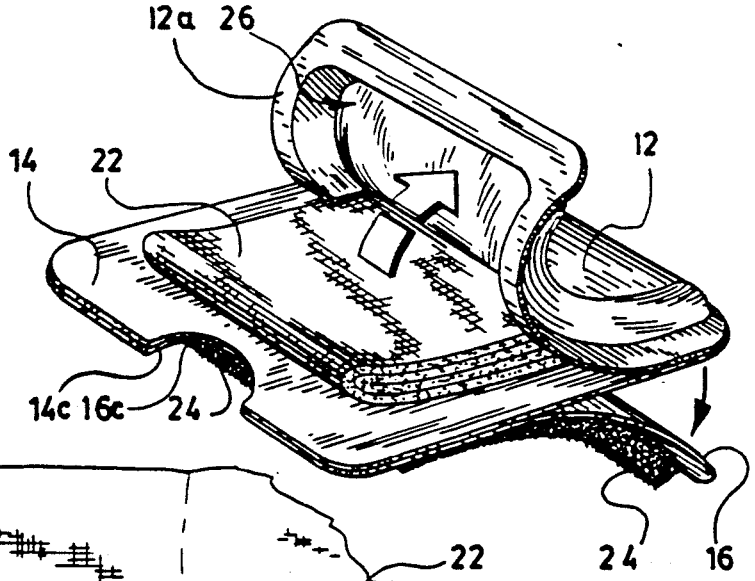
FIG. 9 is a perspective view of the packet with the towel sheet envelopes partly or completely peeled off from their backing sheet.
Figure 10:
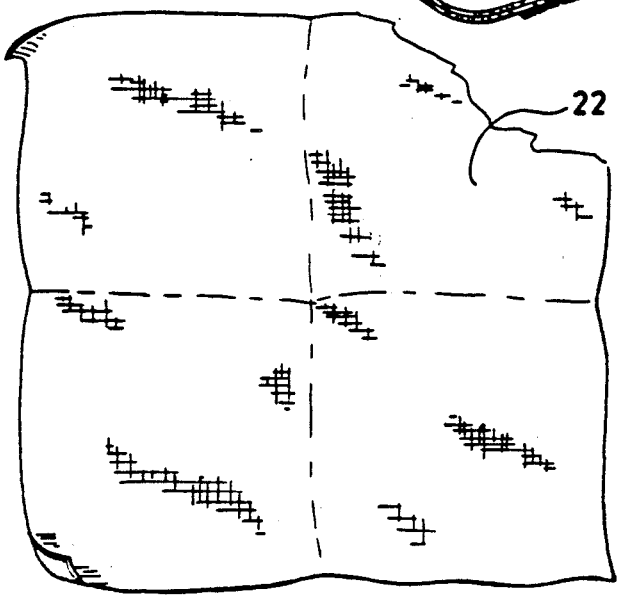
FIG. 10 is a plan view of one of the towel sheets.

If on the other hand, one wishes to clean a toilet bowl seat S, the whole sheet 18 is edgewisely and completely peeled off at ear 18*b* from backing sheet 16, free sponge 24 is wiped over the surface of seat S (FIG. 8) with one's fingers F2 pressing against outer wall 12 toward surface S; then, sheet 12 is itself peeled off from backer sheet 14 starting from notch 14*c*, 16*c* (FIG. 9), and dry (sterile) towel 22 is accordingly removed from sheet 14 to manually dry wetted seat S by rubbing action. The stained towels are then thrown into the toilet bowl.

It is understood that the semi-circular shape of ear 18*b* and of the notches 14*c*, 16*c*, 18*c* is particularly efficient in that, being smoothed surface, it will prevent accidental release thereof (notably for ear 18*b*). It is understood that notches 14*c*, 16*c* and 18*c* constitute a fingertip engaging channel, that will desirably guide that finger in accessing the semi-circular portion 12*a* of sheet 12, see FIGS. 4 and 6. This triple notch channel will in turn facilitate the grasping of that particular sheet portion. Therefore, the triple notch channel 14*c*/16*c*/18*c* constitutes a finger-engaging "locus" for facilitating grabbing and peeling action of the sheet 12, in view of gaining access to the dry towel sealed chamber 26. In a similar fashion, corner slants 14*d*, 16*d*, 18*d* allow corner peeling rather than intermediately primed peeling, without compromising the general integrity of the packet i.e. preventing accidental shearing of walls that are not to be peeled.

It would be highly desirable that the towel, sponge and pouch plastic sheets be made from a biodegradable material, wherein they could be thrown into the water of the toilet bowl without concern to damages to the environment. The pouch, which should be quite small in dimensions, is destined to be portable, i.e. could be carried into a purse, a large pocket in a coat, and the like; it could also be provided in dispensers mounted within public W. C. Of course, other uses for the pouch could easily be envisioned: inter alia, as part of a first aid kit for disinfecting small injuries at home or during trekking/camping trips, to refresh oneself after perspiration following strenous exercise, or to clean eye glasses, restaurant tables or telephone receivers.

I claim:

1. A portable cleansing kit comprising a flat, flexible packet having two separate, stacked, air-tight, openable, flat compartments each comprising two quadrangular walls sealed together around the entire periphery of the walls, the four walls defining a pair of outer walls and a pair of inner walls, the latter walls adjacent to each other and sealed to each other along three sides of their periphery, an opening being formed between the fourth sides of the inner walls to gain access to a planar gap defined between said inner walls, a sponge moistened with a cleansing liquid solution located within one compartment and adhered to the associated inner wall by adhering means, and a sheet of dry, wiping, liquid absorbing towel material loosely contained in the other compartment; wherein said sponge compartment outer wall has an intermediate, outwardly-projecting, semicircular ear about said opening for manual capture and pulling thereof in view of gaining access to said sponge compartment, either by free engagement of a person's finger into said sponge compartment or by outright peeling of the sponge compartment outer wall from the inner wall thereof to completely expose said sponge; and further including a semi-circular notch made edgewisely of said inner walls and of said sponge compartment outer wall intermediately of the edgewise portions thereof opposite said opening, for providing a finger-engaging locus for facilitating peeling action of said dry towel outer wall to gain access to said dry towel.

2. A packet as in claim 1, further including a slanted straight notch made edgewisely of said inner walls and of said sponge compartment outer wall and at one of the two corners of the edgewise portions thereof opposite said opening, for providing a second finger-engaging locus for facilitating peeling action of said dry towel outer wall to gain access to said dry towel.

* * * * *